US006994488B2

(12) United States Patent
Crowley, Sr.

(10) Patent No.: US 6,994,488 B2
(45) Date of Patent: Feb. 7, 2006

(54) APPARATUS FOR PREVENTING HIGH SPEED VEHICLE PURSUITS AND VEHICLE THEFT

(76) Inventor: Patrick J. Crowley, Sr., 32 Alden Ave., Enfield, CT (US) 06082

( * ) Notice: Subject to any disclaimer, the term of this patent is extended or adjusted under 35 U.S.C. 154(b) by 0 days.

(21) Appl. No.: 10/894,894

(22) Filed: Jul. 19, 2004

(65) Prior Publication Data

US 2005/0089368 A1 Apr. 28, 2005

Related U.S. Application Data

(63) Continuation-in-part of application No. 10/694,964, filed on Oct. 28, 2003, now abandoned.

(51) Int. Cl.
*E01F 13/12* (2006.01)

(52) U.S. Cl. ..... 404/6

(58) Field of Classification Search ..... 404/6
See application file for complete search history.

(56) References Cited

U.S. PATENT DOCUMENTS 3,667,160 A * 6/1972 Salloum ..... 49/35
5,322,385 A 6/1994 Reisman
5,419,408 A * 5/1995 Ellrodt et al. ..... 180/287
5,452,962 A 9/1995 Greves
5,482,397 A 1/1996 Soleau
5,536,109 A 7/1996 Lowndes
5,588,774 A 12/1996 Behan
5,689,981 A 11/1997 DeLuca et al.
5,704,445 A 1/1998 Jones
5,775,832 A 7/1998 Kilgrow et al.
6,048,128 A * 4/2000 Jones et al. ..... 404/6
6,155,745 A 12/2000 Groen et al.
6,390,245 B1 5/2002 Metz
6,474,903 B1 * 11/2002 Marts et al. ..... 404/6
6,749,362 B1 * 6/2004 Eichenberg ..... 404/6

* cited by examiner

*Primary Examiner*—Gary S. Hartmann
(74) *Attorney, Agent, or Firm*—Lambert & Associates; Gary E. Lambert

(57) ABSTRACT

The apparatus of the present invention is apparatus for preventing high speed vehicle pursuits and vehicle theft. The apparatus includes spikes for deflating a vehicle tire known in the art, disposed on opposing blocks or chocks, further secured to adjustable supports. The spikes and opposing blocks are positioned so to compress against the lower front and lower back surfaces of a vehicle tire. A vertical user engageable member is secured to the support facilitating placement around a vehicle tire.

1 Claim, 12 Drawing Sheets

APPARATUS FOR PREVENTING HIGH SPEED VEHICLE PURSUITS AND VEHICLE THEFT

CROSS REFERENCE TO RELATED APPLICATIONS

This application claims the benefit in the form of a continuation-in-part under 37 C.F.R. 1.53(b)(1) of currently pending parent application, Ser. No. 10/694,964 filed Oct. 28, 2003, now abandoned, by the same inventor.

FIELD OF THE INVENTION

The present invention relates generally to apparatuses having the purpose of disabling the progress of a vehicle, and in particular to apparatuses for preventing high speed vehicle pursuits and vehicle theft.

BACKGROUND OF INVENTION

In the area of law enforcement, police and other law enforcement officers are commonly required to stop and question motorists. Frequently, these traffics stops occur on the side of the road. During a traffic stop, there is a possibility that a motorist may attempt to flee causing the officer to pursue the fleeing vehicle at high speeds. Such incidents cause injuries to law enforcement officers and damage to law enforcement vehicles due to collisions caused by high speed chases. Additionally, the fleeing vehicle may harm individuals and property not involved in the traffic stop. Law enforcement agencies may be required to bear the costs of workers' compensation claims, personal injury and other lawsuits against the law enforcement agency, and insurance claims resulting from vehicle damage. Therefore, a means for deterring a detained motorist from fleeing the scene is desired. One such means possesses a mechanism for deflating vehicle tires of a fleeing motorist in order to prevent the motorist from achieving high speeds and prevent injury and or death to innocent bystanders.

The utility patents U.S. Pat. No. 5,482,397 and U.S. Pat. No. 5,704,445 issued to Soleau and Jones respectively, disclose a tire deflator including a spike secured to a support mechanism such that upon contact with a tire of a moving vehicle the spike penetrates the tire causing rapid air depletion. However, Soleau and Jones lack a means for positioning the apparatus on either side of the tire. Additionally, Soleau and Jones require the user to position the chocks underneath the vehicle wheel by hand, causing law enforcement officers to be vulnerable to injury if the vehicle moves. Therefore, an apparatus is needed that is easily positioned on a vehicle tire without exposing a user's body to possible harm.

The Soleau and Jones patents also fail to include a mechanism for protecting users from the disclosed spikes during placement and while the apparatuses are not in use. Therefore, an apparatus is needed that protects individuals from injury caused by inadvertent contact with deflating spikes.

The utility patent U.S. Pat. No. 5,689,981 issued to DeLuca et al. discloses an anti-theft vehicle wheel lock wherein a chock is positioned against a vehicle tire coupled with a bar on the opposing side securing the chock in place. Furthermore, a lock prevents movement of the chock and opposing bar, and a handle extends upward facilitating placement of the device. However, DeLuca et al. only is effective when locked into place, which takes time, and has no effect to prevent a high speed chase such as deflating vehicle tires. Therefore, an apparatus is needed that is easily placed and may be used in an unlocked position in order to prevent a vehicle from achieving high speeds.

For these reasons, in order to prevent high-speed pursuits and theft, a deflating apparatus is needed that is easily placed, without exposing a user's body to harm.

SUMMARY OF THE INVENTION

The apparatus of the present invention, an apparatus for preventing high speed vehicle pursuits and vehicle theft, includes spikes, or other means for deflating a vehicle tire known in the art, disposed on opposing blocks or chocks, further secured to adjustable supports. A vertical user engageable member is secured to the support facilitating placement around a vehicle tire.

The apparatus has two positions, stored and deployed. While the apparatus is in the stored position, the supports are folded upward toward the vertical user engageable member. The spikes are pointed downwards or horizontally towards the opposing block causing the blocks to cover the spikes and protect individuals from unintentional contact and resulting injury. In order to deploy the device, the supports are propelled downward by a spring force, or other deploying mechanism known in the art, when activated by a user.

Once deployed, the apparatus is locked into position. A user places the apparatus around a vehicle tire using the vertical user engageable member allowing placement without exposing a user's body to harm or the need for locking the apparatus around the tire. The blocks are positioned along side the outside front and back surfaces of the vehicle tire. The spikes and opposing blocks are positioned so to compress against the lower front and lower back surfaces of a vehicle tire. Foam or cushioning may be placed over the spikes in order to further protect users from exposed spikes. Due to the durability of a vehicle tire, the spikes will not penetrate causing deflation unless a strong force is applied on the spikes, such as vehicle propelled movement.

If an individual attempts to move the vehicle, the spikes, or other deflating means, puncture the tire, thus releasing the air in the tire well before the vehicle gains any significant forward or reverse motion while at the same time not rendering the vehicle out-of-control from the operator. Thus, escape at high speeds is prevented. The spikes are capable of piercing any sized vehicle tire; regardless of the speed or direction the vehicle attempts to flee.

These and other features, aspects and advantages of the present invention will become better understood with reference to the following description, claims, and accompanying drawings. Therefore, the form of the invention, as set out above, should be considered illustrative and not as limiting the scope of the following claims.

DESCRIPTION OF THE INVENTION

Figure 1:
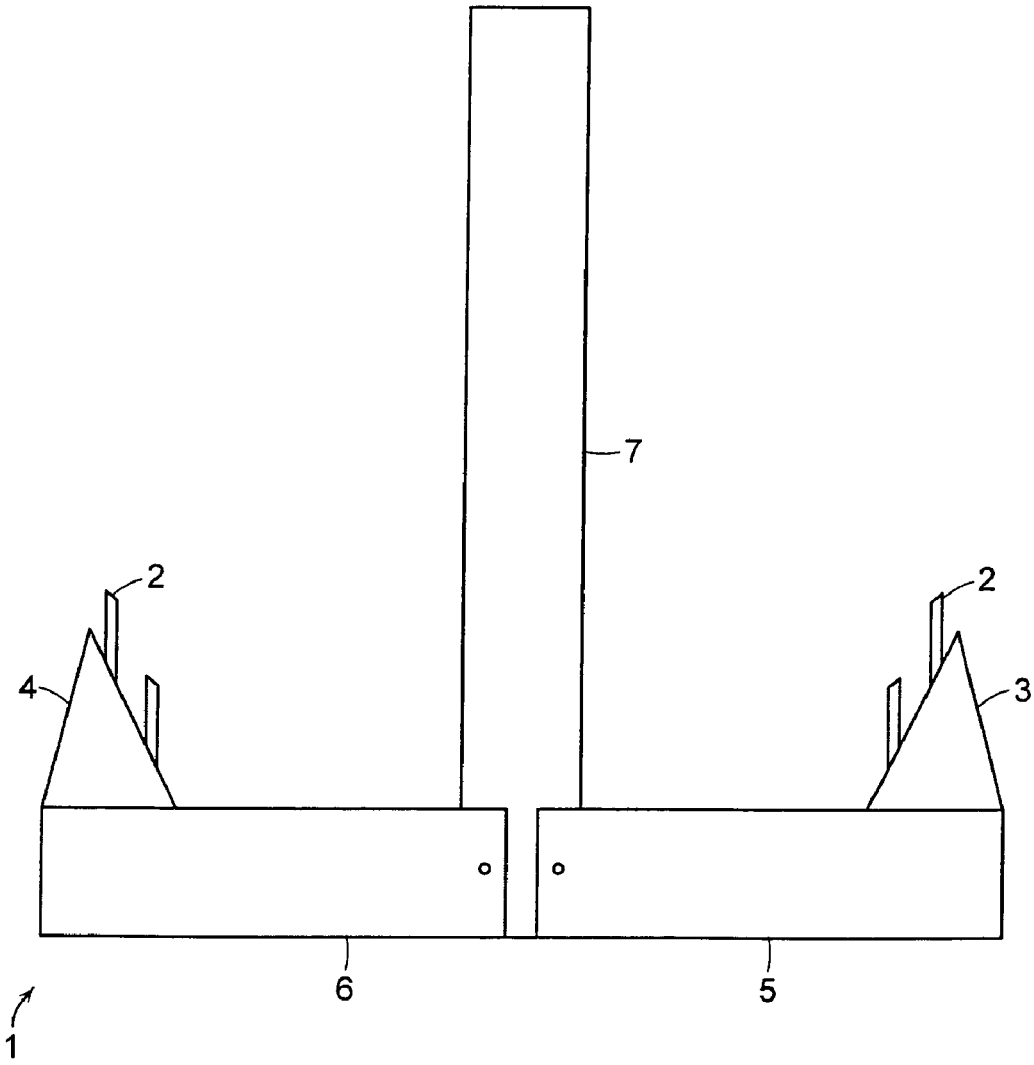
FIG. 1 is a front prospective view of an embodiment of the apparatus for preventing high speed vehicle pursuits and vehicle theft in deployed position.
Figure 2:
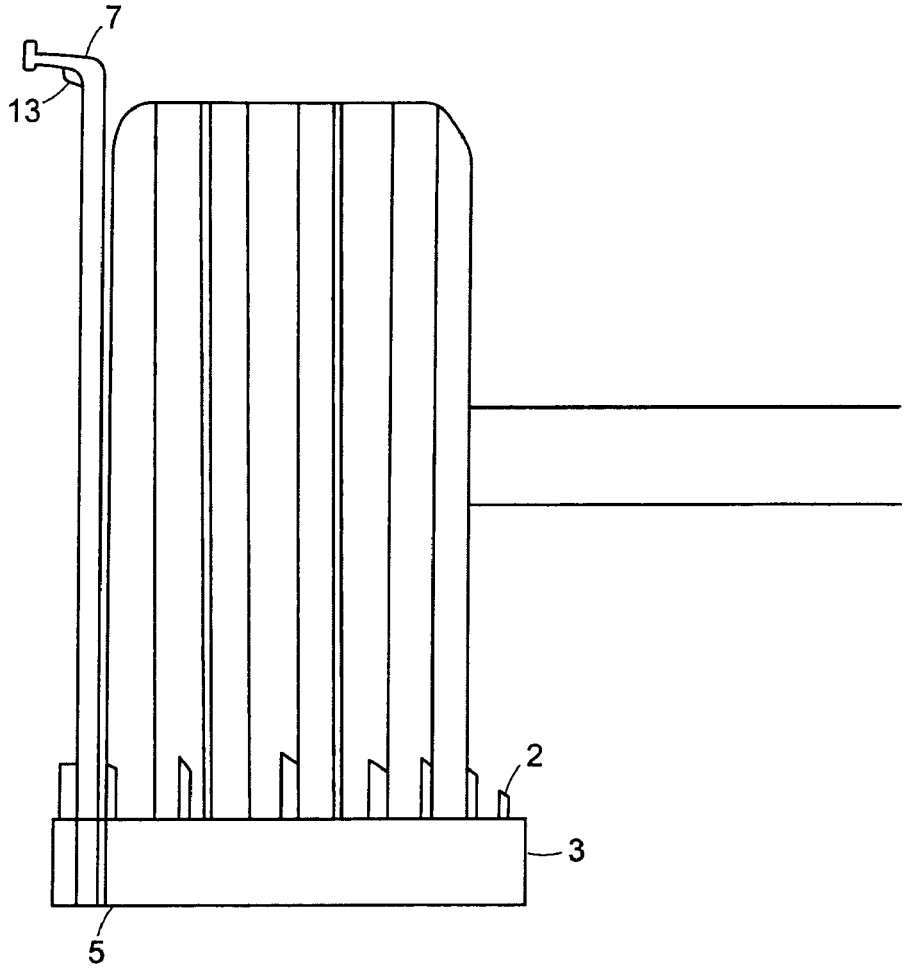
FIG. 2 is a side view of an embodiment of the apparatus for preventing high speed vehicle pursuits and vehicle theft placed around a vehicle tire in deployed position.
Figure 3:
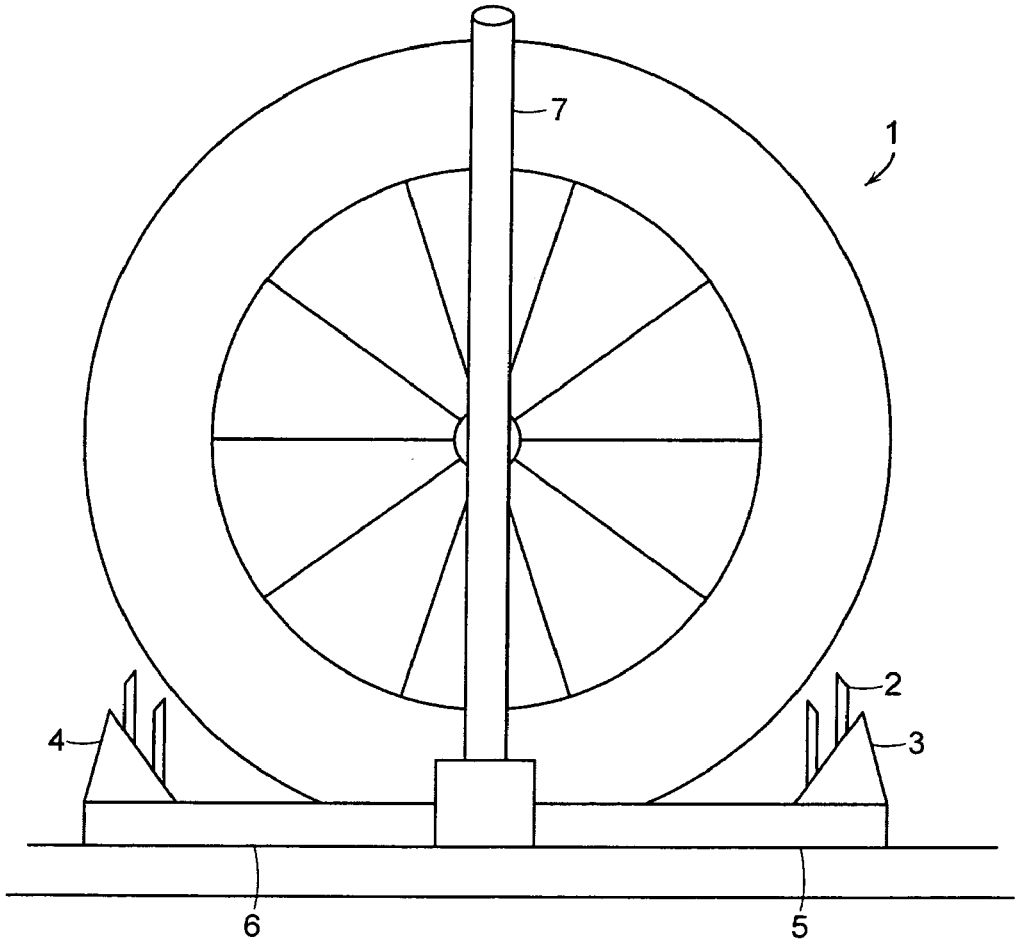
FIG. 3 is a rear view of an embodiment of the apparatus for preventing high speed vehicle pursuits and vehicle theft placed around a vehicle tire in deployed position.

The preferred embodiment of the present invention represents an apparatus for preventing high speed vehicle pursuits and vehicle theft as shown in FIGS. 1–10. The apparatus 1 of the present invention includes spikes 2, or other means for deflating a vehicle tire known in the art, disposed on blocks 3, 4. The blocks 3, 4 are secured to supports 5, 6. A user places the apparatus 1 using a vertical user engageable member 7 allowing placement without exposing a user's body to harm. The spikes 2 and opposing blocks 3, 4 are positioned so to compress against the lower front and lower back surfaces of a vehicle tire. The spikes 2 may be hollow spikes, blades or other deflating means, and foam 15 (see FIG. 11) or cushioning may be placed over the spikes 2. The apparatus 1 is comprised of steel or other high strength material with similar properties.

Figure 4:
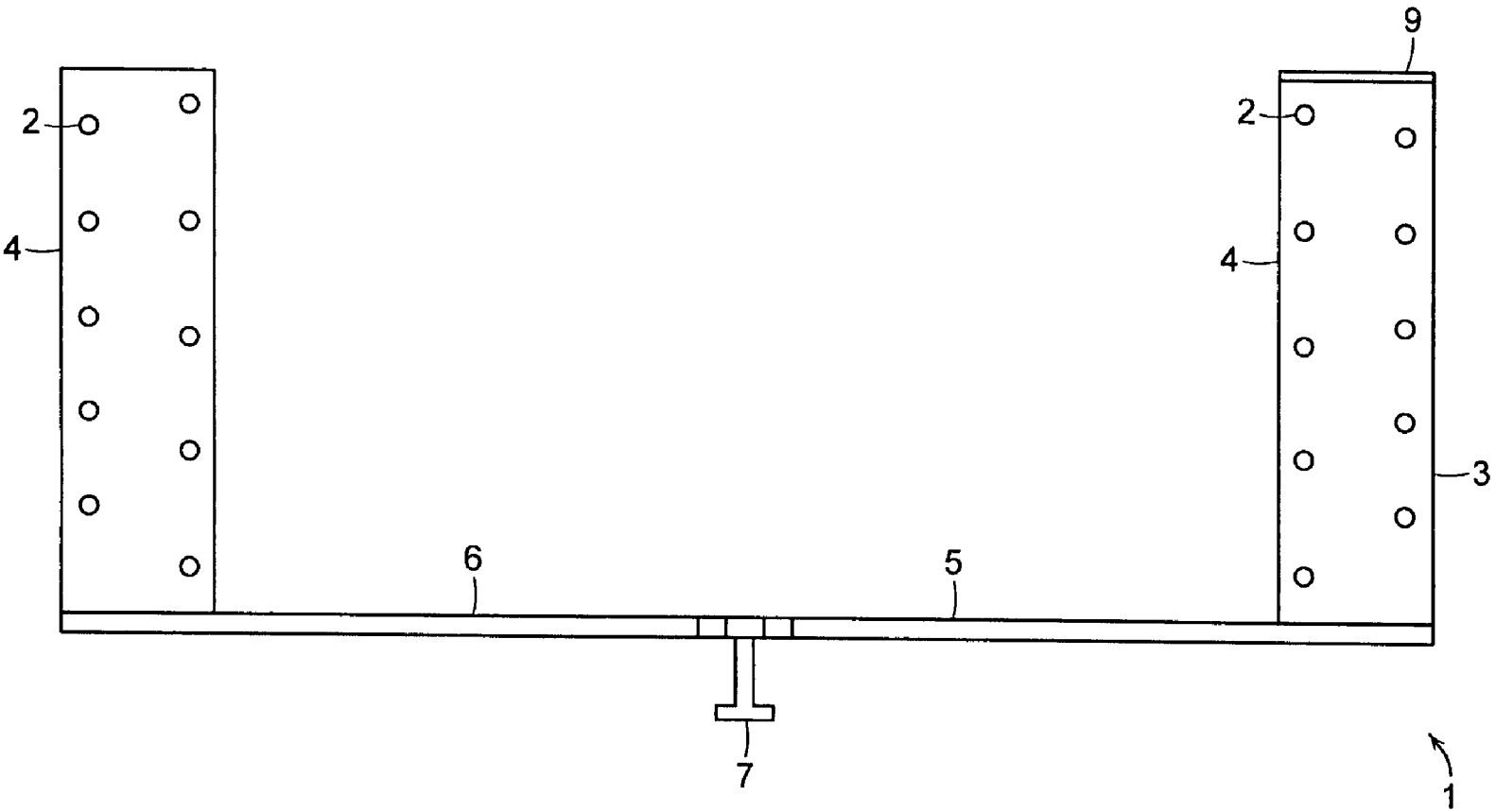
FIG. 4 is a top view of an embodiment of the apparatus for preventing high speed vehicle pursuits and vehicle theft.
Figure 5:
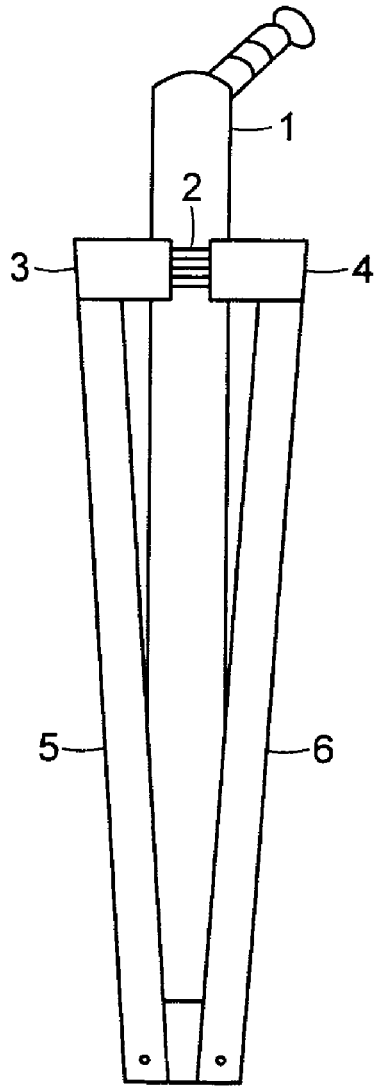
FIG. 5 is a front view of an embodiment of the apparatus for preventing high speed vehicle pursuits and vehicle theft in stored position.

The apparatus has two positions, stored as shown in FIG. 5 and deployed as shown in FIGS. 1–4. While the apparatus 1 is in stored position, the supports 5, 6 are folded upward toward the vertical user engageable member 7 and fastened as shown in FIG. 5. The spikes 2 are pointed downwards or horizontally towards the opposing block 3, 4 causing the blocks 3, 4 to cover the spikes 2 and protect unintentional contact and resulting injury. As seen in FIG. 4, in order to deploy the apparatus 1, the supports 5, 6 are propelled downward, due to a spring force or any other force exerting mechanism 9 as known in the art. Activation may be controlled by a trigger, push button or key operated mechanism 13 or any other such actuation mechanism as known in the art, in cooperation with the chosen force exerting mechanism 9.

Once deployed, the apparatus 1 is locked in deployed position as shown in FIGS. 1–4. A user places the apparatus 1 around a vehicle tire using the vertical user engageable member 7 allowing placement without exposing any part of the body in front of or behind a vehicle tire, thus, susceptible to crushing were the vehicle to move. The blocks 3, 4 are positioned along side the outside front and back surfaces of the vehicle tire. The spikes 2 and opposing blocks 3, 4 are positioned so to compress against the lower front and lower back surfaces of a vehicle tire.

While the apparatus 1 is in place, if the vehicle begins to move, the spikes 2, or other deflating means, puncture the tire, thus releasing the air in the tire well before the vehicle gains any significant forward or reverse motion while at the same time not rendering the vehicle out-of-control. The apparatus can be modified such that the spikes 2 are capable of piercing any sized vehicle tire; regardless of the speed or direction the vehicle attempts to flee.

In a further embodiment, at least one retaining arm 8 may be utilized to protect the user, as shown in FIGS. 6–10. At least one retaining arm 8 may be attached or contained within one of the blocks 3, 4. Further, one retaining arm 8 may be attached to each of the blocks 3, 4, thus constituting a set of retaining arms 8. The individual or set of retaining arms 8 may be utilized to prevent the vehicle occupant or any other person on the scene of a traffic stop from removing the apparatus 1. Once the apparatus 1 is engaged, actuation of the retaining arms 8 will work to inhibit the removal of the apparatus 1 by restricting the movement of the rearward portion 12 of the apparatus 1 beyond the rear side of the automobile wheel.

Figure 6:
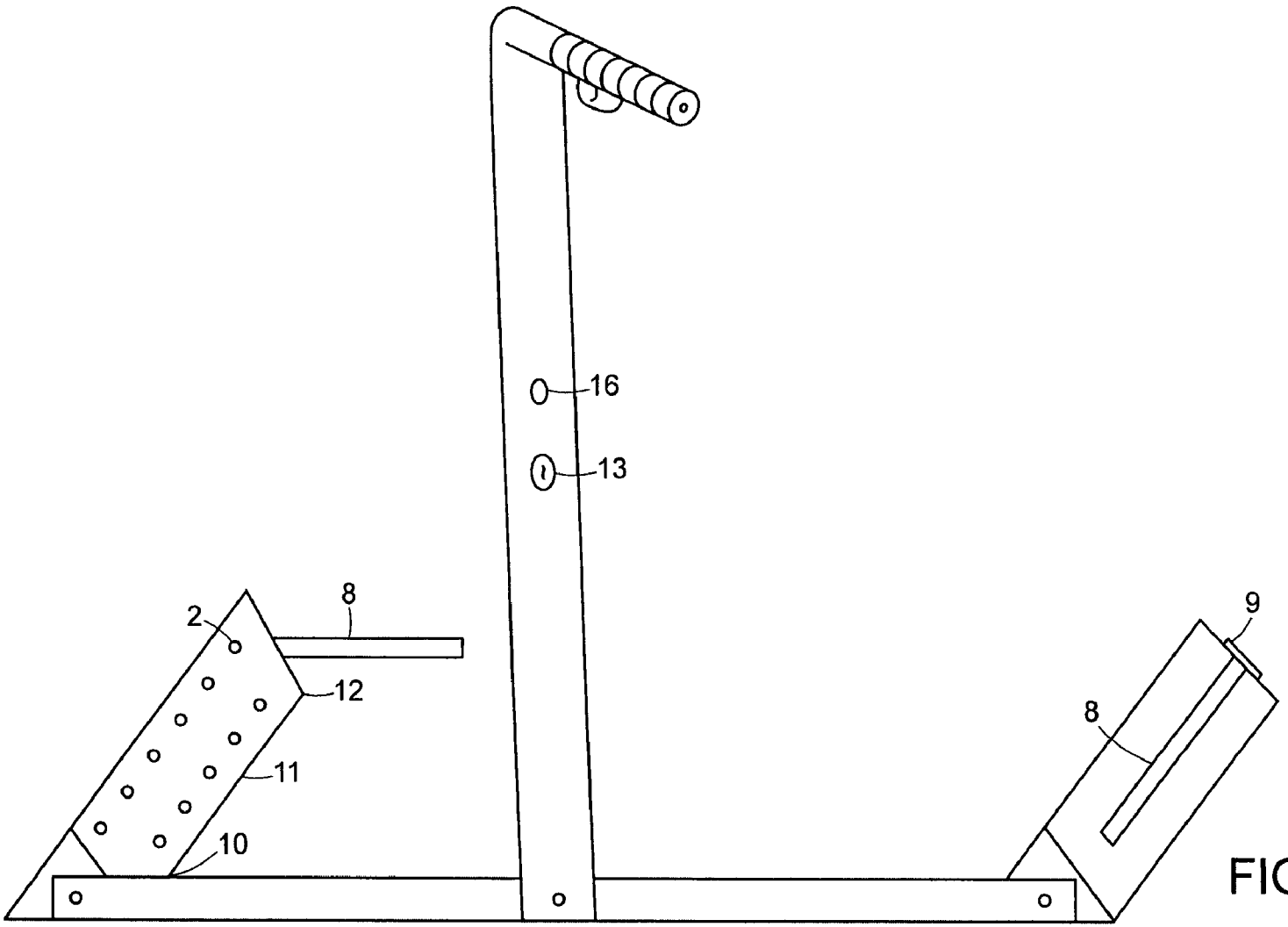
FIG. 6 is a front view of an embodiment of the apparatus for preventing high speed vehicle pursuits and vehicle theft with a set of retaining arms, one in the operational position and the other in the horizontally stored position.

The retaining arms 8 may be comprised of rigid, partially flexible or entirely flexible members. Additionally, the retaining arms 8 may be configured in an initially vertical position, horizontal position, a folded position, or contained inside the blocks 3, 4 as shown in FIGS. 6–10. Further, as shown in FIG. 6, the apparatus 1 may be equipped with a means to automatically detach the retaining arms 8 such as an emergency detachment button 16.

Figure 7:
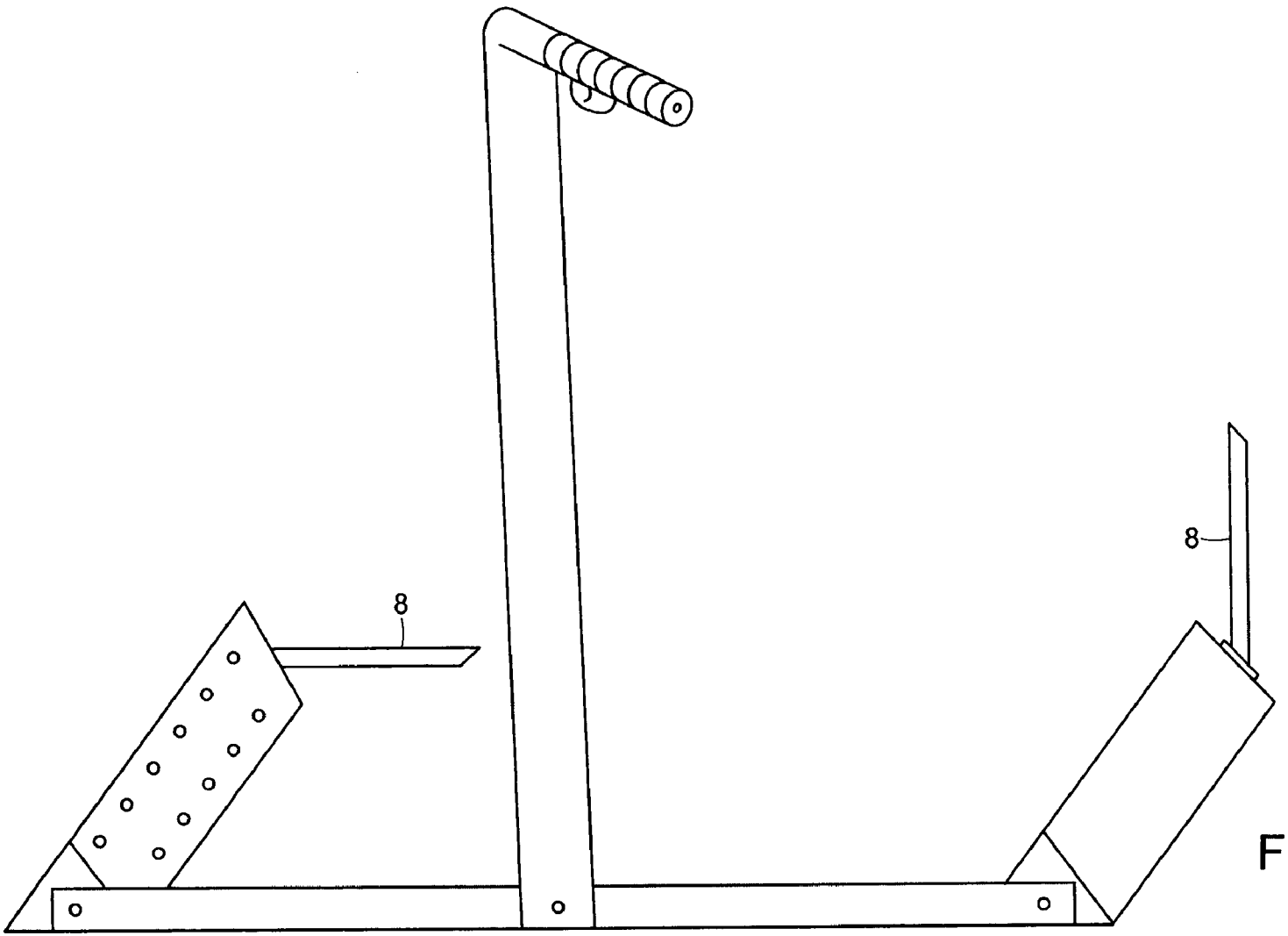
FIG. 7 is a front view of an embodiment of the apparatus for preventing high speed vehicle pursuits and vehicle theft with a set of retaining arms, one in the operational position and the other in the vertically stored position.

The blocks 3, 4 may possess a frontward portion 10, median portion 11 and a rearward portion 12. The set of retaining arms 8 may be also attached to the rearward portion 12 of blocks 3, 4, and stored horizontally as seen in FIG. 6. The set of retaining arms 8 may be attached to the rearward portion 12 of blocks 3, 4, and stored vertically as seen in FIG. 7.

Figure 8:
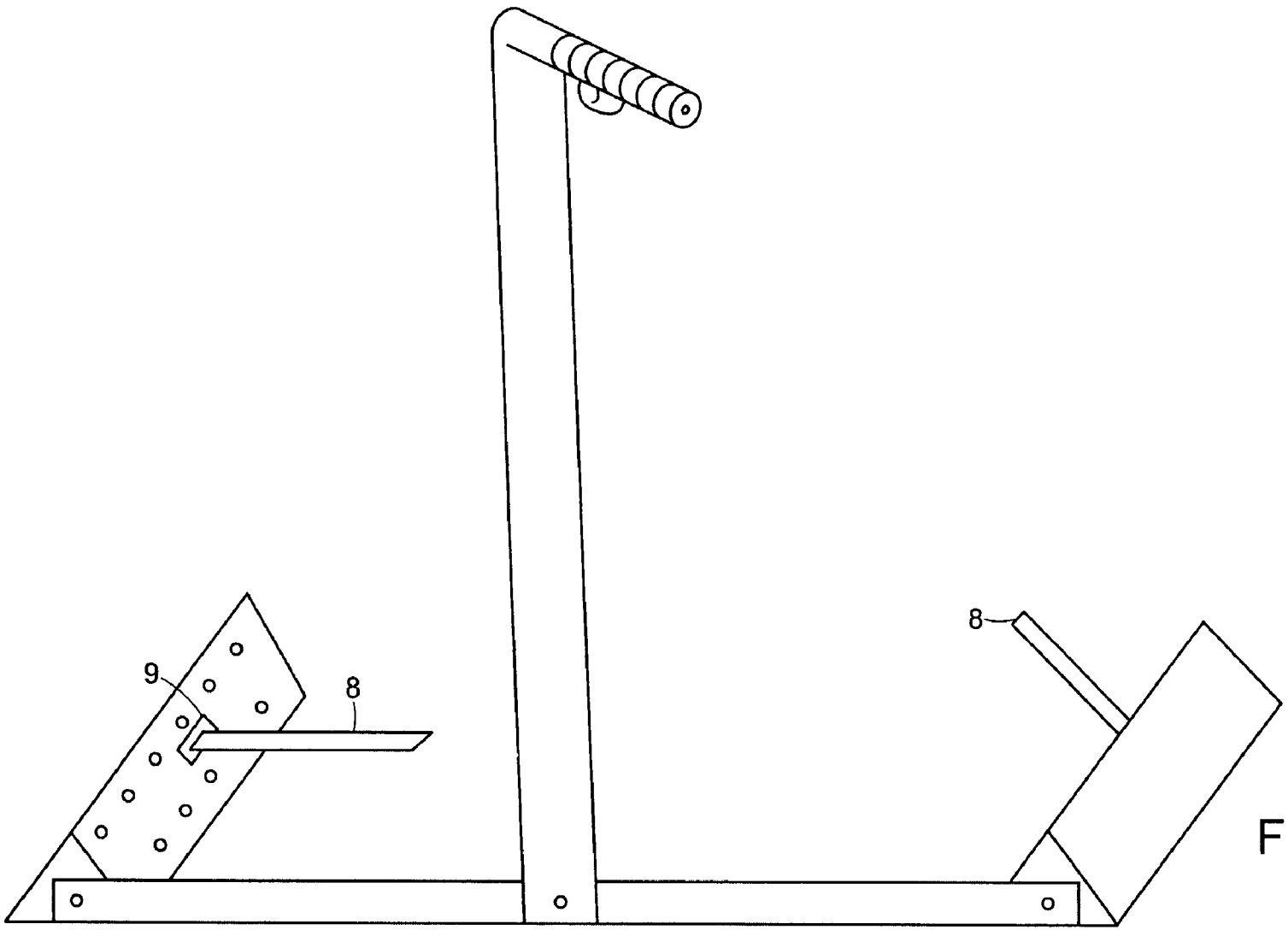
FIG. 8 is a front view of an embodiment of the apparatus for preventing high speed vehicle pursuits and vehicle theft with a set of retaining arms attached to the median portion of the blocks, one retaining arm is in the operational position and the other in the vertically stored position.

Additionally, the set of retaining arms 8 may also be attached to the median portion 10 of the blocks 3, 4, and stored vertically. FIG. 8 is a front view of an embodiment of the apparatus for preventing high speed vehicle pursuits and vehicle theft with a set of retaining arms attached to the median portion of the blocks, one retaining arm is in the operational position and the other in the vertically stored position.

When stored in the initially vertical position, as seen in FIG. 6, the retaining arms 8 may have a rigid composition. The retaining arms 8 may be held in a vertical position by spring loaded components or other such force exerting mechanism 9. The force exerting mechanism 9 may be externally or internally housed. Thus when the retaining arms 8 are pressed into operational status, the force upon the retaining arms 8 may be decreased to allow for lowering of the retaining arms 8 to a horizontal position. Additionally, an opposite configuration may be utilized wherein said force exerting mechanism 9 may hold the retaining arms 8 in the vertical position and the force will be removed in order to allow the retaining arms 8 to fall to a horizontal, operational position.

Further, the retaining arms 8 may be configured in an initially horizontal position and contained on the outer surface of the blocks 3, 4 as shown in FIG. 6–10. Also as illustrated in FIG. 6–10, a force exerting mechanism 9 may be used to either store or actuate the retaining arms 8.

Figure 9:
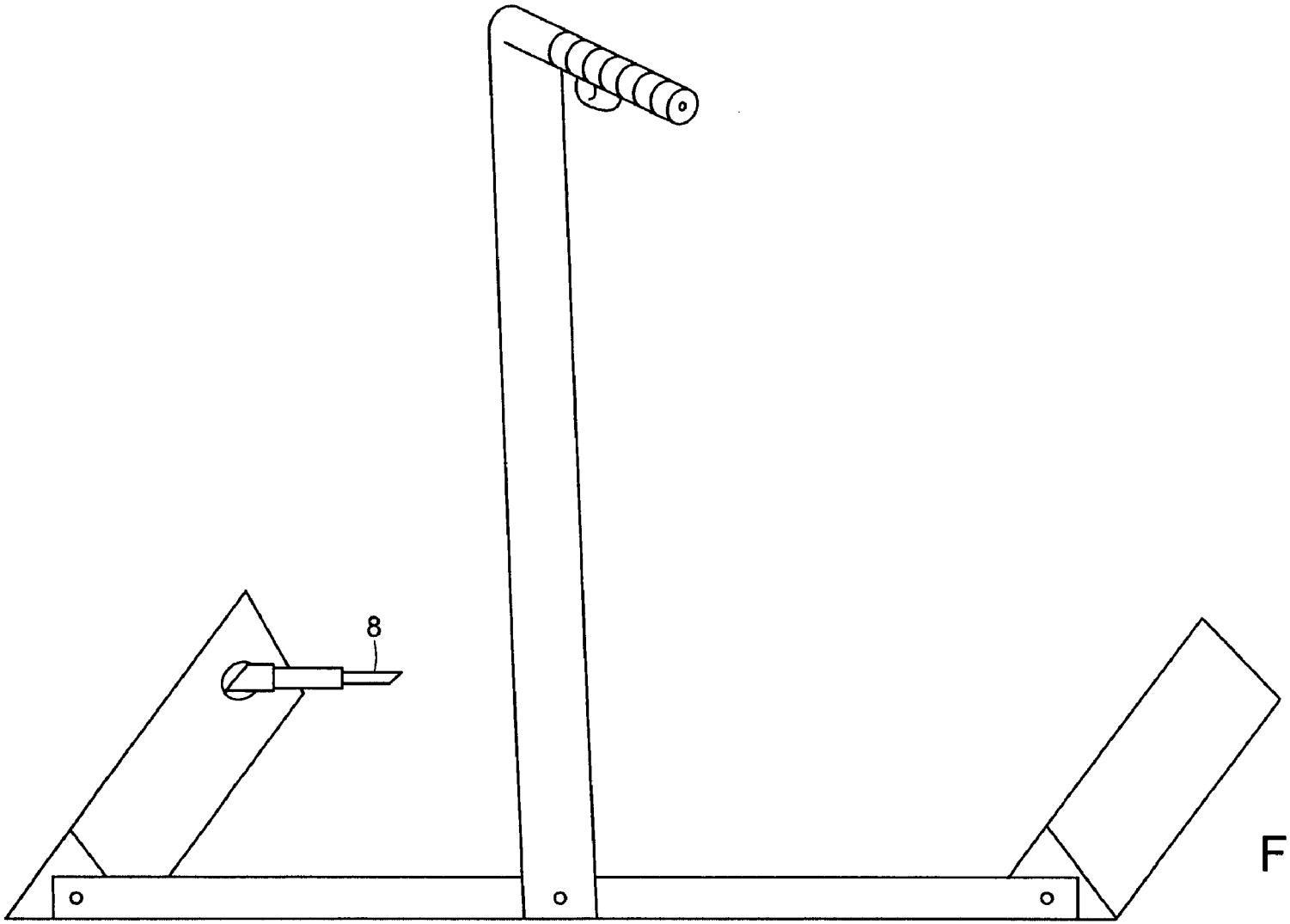
FIG. 9 is a front view of an embodiment of the apparatus for preventing high speed vehicle pursuits and vehicle theft with a set of retaining arms internally contained within the rearward portion of the blocks and having a telescoping ability.
Figure 10:
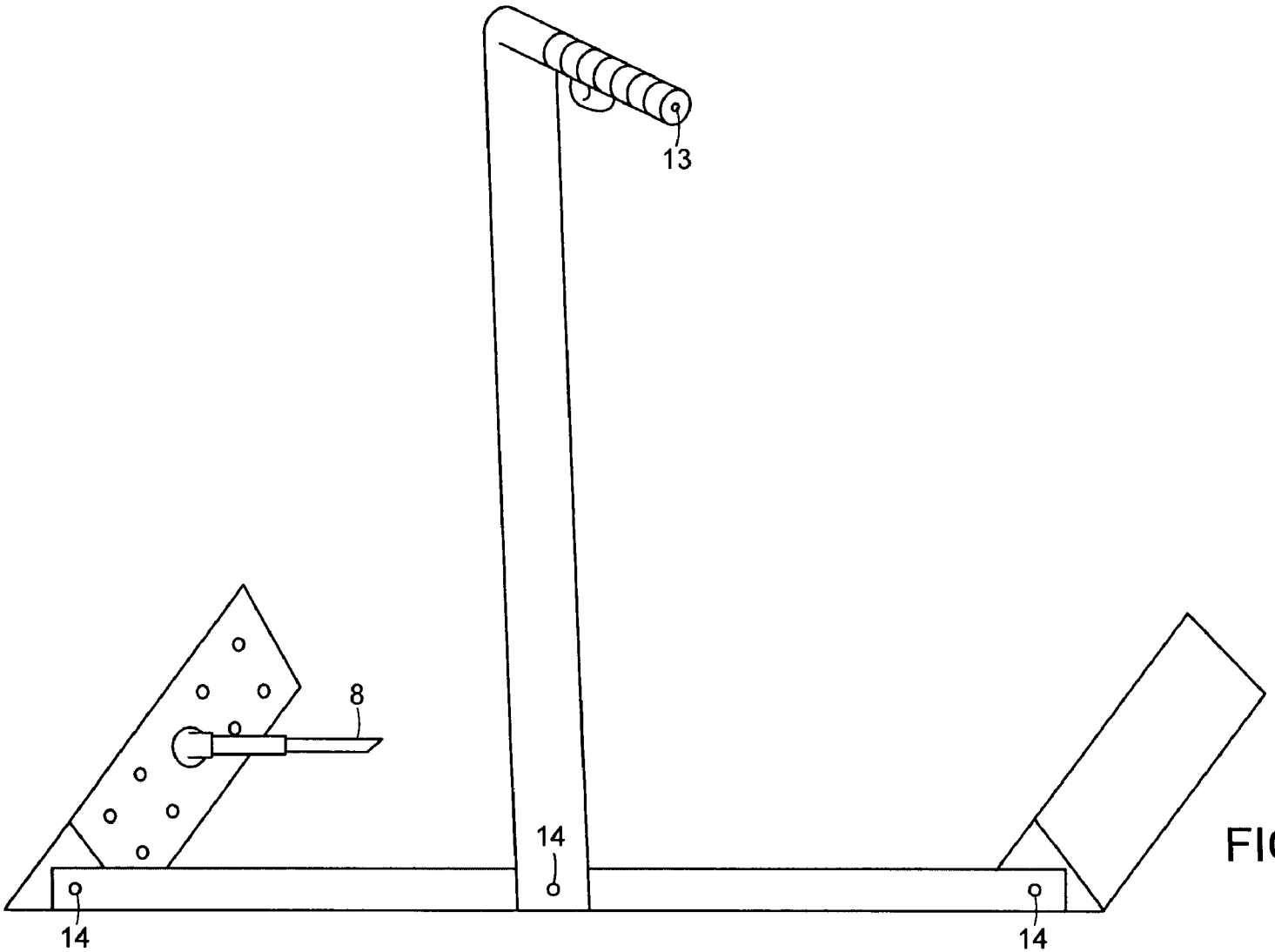
FIG. 10 is a front view of an embodiment of the apparatus for preventing high speed vehicle pursuits and vehicle theft with a set of retaining arms internally contained within the median portion of the blocks and having a telescoping ability.

Further, the set of retaining arms 8 may be contained internally within the median portion 11 or the rearward portion 12 of the block 3, 4, as seen in FIG. 8. In this capacity, the retaining arms 8 may have a telescoping ability and be retractable upon completion of usage as shown in FIGS. 8 and 9. FIG. 9 is a front view of an embodiment of the apparatus for preventing high speed vehicle pursuits and vehicle theft with a set of retaining arms internally contained within the rearward portion of the blocks and having a telescoping ability. FIG. 10 is a front view of an embodiment of the apparatus for preventing high speed vehicle pursuits and vehicle theft with a set of retaining arms internally contained within the median portion of the blocks and having a telescoping ability.

In further embodiments, the apparatus may be equipped with partially or entirely flexible retaining arms 8. These arms may be initially folded and comprise a spring loaded system which actuates the retaining arms 8 upon release by a mechanism.

Upon deployment of the apparatus 1, the retaining arms 8 may be automatically or manually activated and deactivated in a number of manners. For manual operation of the retaining arms 8, a push button or key operated mechanism 13, as known in the art may be utilized, as seen in FIG. 8. In order to activate and deactivate the arms a mechanically or electrically controlled system may be utilized. This system may be connected through and located internally within the supports 5, 6 or vertical user engageable member 7, depending upon where an appropriate actuation means is located, as shown in FIG. 10.

Figure 11:
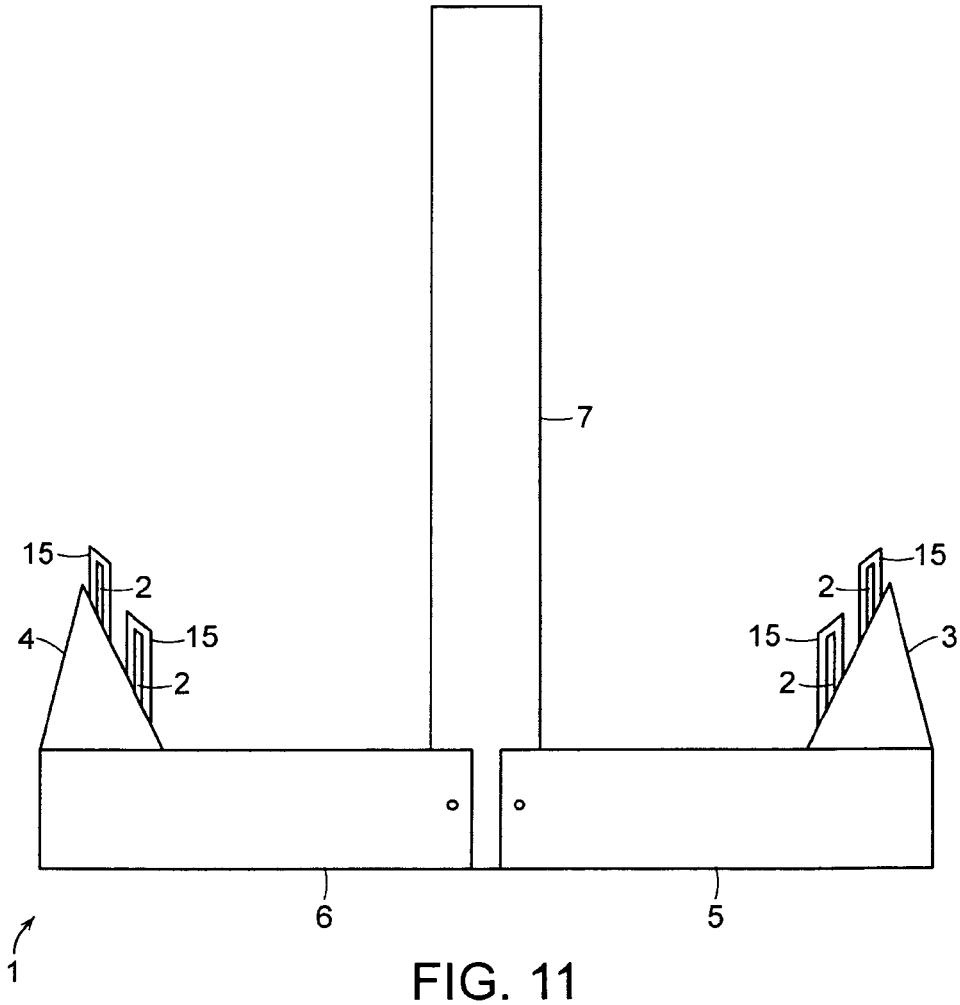
FIG. 11 is a front perspective view of a further embodiment of the apparatus for preventing high speed vehicle pursuits and vehicle theft in the deployed position with the spikes covered by foam.

In a further embodiment, as shown in FIG. 11, the spikes 2 of the apparatus 1 may be covered by foam 15.

Figure 12A:
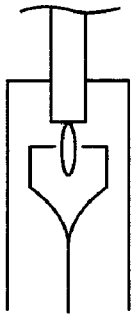
FIGS. 12*a*, 12*b*, and 12*c* are views of the retaining arm of the apparatus depicting the automatic detachment of the retaining arm.
Figure 12B:
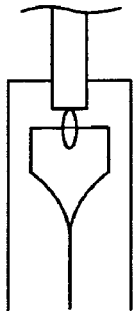
Figure 12C:
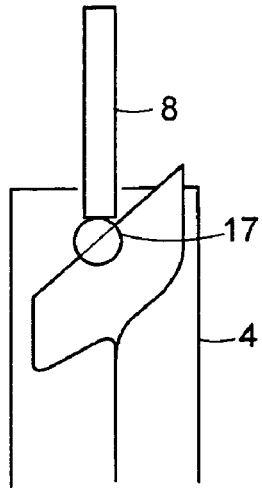

In a further embodiment, as shown in FIGS. 12*a*, 12*b*, and 12*c*, the apparatus 1 may be equipped with a means to automatically detach the retaining arms 8. As shown in FIG. 12*c*, when triggered by the emergency detachment button 16 (FIG. 6), the holding loop 17 releases the retaining arm 8. FIG. 12*a* depicts the open position of the automatic detachment means. FIG. 12*b* depicts the closed position of the automatic detachment means.

In all configurations, the set of retaining arms 8 may be equipped with at least one or a multiplicity of emergency release or ejection buttons 14 in case the need to dispense of the set of retaining arms 8 in a hasty fashion should arise. An emergency release mechanism may be utilized to enagage or disengage the retaining arm 8 vertical user engageable member 7.

What is claimed is:

1. An apparatus for preventing high speed vehicle pursuits and vehicle theft comprising:

a plurality of spikes;

at least one block secured to the plurality of spikes wherein said block possess a frontward portion, median portion and a rearward portion;

at least one support having a proximal end and a distal end wherein said distal end of said support is secured to said block; and a vertical user engageable member secured to the proximal end of the support; and, at least one retaining arm attachable to said block for retaining said spikes wherein said at least one retaining arm comprises a telescoping design.

* * * * *